United States Patent [19]

Sujansky et al.

[11] Patent Number: 4,507,161

[45] Date of Patent: Mar. 26, 1985

[54] NITRIC ESTER EXPLOSIVE COMPOSITIONS

[75] Inventors: Vladimir Sujansky, Burwood; Sergio Tribuzio, Tullamarine; Jolanta Paull, Hawthorn East, all of Australia

[73] Assignee: ICI Australia Limited, Melbourne, Australia

[21] Appl. No.: 576,340

[22] Filed: Feb. 2, 1984

[30] Foreign Application Priority Data

Feb. 15, 1983 [AU] Australia ..... PF8039

[51] Int. Cl.[3] ..... C06B 45/02

[52] U.S. Cl. ..... 149/21; 149/2; 149/38; 149/40; 149/41; 149/42; 149/43; 149/44; 149/47; 149/51; 149/52; 149/53; 149/62; 149/66; 149/70; 149/71; 149/72; 149/73; 149/76; 149/77; 149/78; 149/82; 149/83; 149/85; 149/88; 149/101; 149/102; 149/104

[58] Field of Search ..... 149/2, 21, 38, 40, 41, 149/42, 43, 44, 47, 51, 52, 53, 62, 66, 70, 71, 72, 73, 76, 77, 78, 82, 83, 85, 88, 101, 102, 104

[56] References Cited

U.S. PATENT DOCUMENTS

| | | | |
|---|---|---|---|
| 4,386,977 | 6/1983 | Ikeda et al. | 149/2 |
| 4,394,198 | 7/1983 | Tareuchi et al. | 149/46 X |
| 4,414,044 | 11/1983 | Tareuchi et al. | 149/2 |

*Primary Examiner*—Stephen J. Lechert, Jr.

*Attorney, Agent, or Firm*—Cushman, Darby & Cushman

[57] ABSTRACT

This invention concerns a dynamite type explosive composition which comprises at least one liquid explosive nitric ester and an emulsion composition comprising an oxygen-releasing salt phase, an organic phase and an emulsifier. The invention provides dynamite type compositions in which the amount of liquid explosive nitric ester can be significantly reduced without adversely affecting the performance and physical properties of the composition.

34 Claims, No Drawings

NITRIC ESTER EXPLOSIVE COMPOSITIONS

This invention relates to new nitric ester type or dynamite explosive compositions and, more particularly, to compositions comprising a reduced amount of explosive nitric ester.

Dynamites are based on liquid explosive nitric ester materials such as nitroglycerine, ethylene glycol dinitrate and mixtures thereof and therefore are relatively expensive blasting agents. However, because of their excellent performance and physical properties dynamites are still widely used industrial explosives.

The dynamites manufactured for industrial use range in physical properties from powder compositions, which contain a lower proportion of liquid explosive nitric ester, to the so-called gelatin compositions which contain higher proportions of liquid explosive nitric ester materials in gelatinized form. The 20 gelatin dynamites are particularly preferred because of their high performance, water-proofness and their plastic consistency which allows them to be shaped into cartridges by conventional extruder type or roller-type cartridging machines. However, the higher liquid explosive nitric ester content of the gelatin dynamites means that they are relatively expensive and suffer the manufacturing, handling and storage problems inherent with the use of the highly explosive and poisonous liquid explosive nitric esters.

U.S. Pat. No. 3,356,547 discloses dynamite-type explosive compositions prepared by mixing water-in-oil emulsions comprising a liquid explosive nitric ester oil phase with solid explosive adjuvants such as nitrate salts. The disclosure teaches that such compositions have an economic advantage as the percentage of liquid explosive nitric ester can often be reduced. However, such compositions clearly suffer the disadvantage of requiring the emulsification, usually achieved by vigorous agitation, of a neat liquid explosive nitric ester having high detonation sensitivity.

It has also been proposed, in U.S. Pat. No. 3,450,584, that the liquid explosive nitric ester content of dynamite-type explosive compositions can be reduced, by blending into the dynamite a gel of a polyvinyl butyral resin, a solvent for the resin, and a surfactant.

An alternative, highly practical, way of reducing the liquid explosive nitric ester content of dynamite-type explosive compositions, without adversely affecting their performance and physical properties, has now been found in which an emulsion of an oxygen-releasing salt phase and an organic fuel phase is incorporated in the composition.

Accordingly the invention provides a dynamite-type explosive composition comprising a dynamite component which comprises at least one liquid explosive nitric ester and an emulsion component which comprises an oxygen-releasing salt phase, an organic fuel phase and an emulsifier.

Typically, the dynamite-type explosive compositions of the present invention comprise from 25 to 99, and preferably from 50 to 98, percent by weight of said dynamite component and from 75 to 1, and preferably from 50 to 2, percent by weight of said emulsion component.

The term "dynamite-type explosive composition" is used herein to refer to the full range of explosive compositions which contain liquid explosive nitric esters. Such compositions range from the powder compositions which contain a low proportion of liquid explosive nitric ester material adsorbed onto a high proportion of solids to the so-called gelatin compositions which are produced by gelatinizing a liquid explosive nitric ester material. Such gelatin compositions range from those containing a considerable proportion of solid materials to the so-called "straight" dynamites which essentially comprise only gelatinized liquid explosive nitric ester material.

Examples of liquid explosive nitric esters which may be used in dynamites, and therefore in the dynamite component of the explosive compositions of the present invention, include nitroglycerine, ethylene glycol mononitrate, ethylene glycol dinitrate, diethylene glycol dinitrate, triethylene glycol dinitrate, trimethylene glycol dinitrate, methyl glycol dinitrate, 1,3-butylene glycol dinitrate, butane-1,2,4-triol trinitrate, 1,1,1-trimethylolethane trinitrate, dimethylolnitroethane dinitrate, liquid explosive nitric esters of sugars and sugar derivatives such as sorbitol and mixtures thereof. Such liquid explosive nitric esters, or mixtures thereof, may also be modified by additives such as nitrobenzene, nitrotoluene, dinitrotoluene and trinitrotoluene. The liquid explosive nitric esters which are preferred for use in dynamites, and therefore in the dynamite component of the explosive compositions of the present invention, include nitroglycerine, ethylene glycol dinitrate and 1,1,1-trimethylolethane trinitrate (metriol trinitrate).

Typically, dynamites contain from as low as 5% up to approximately 100% by weight of liquid explosive nitric ester material. For example, the so-called powder dynamites contain from 5 to 10% by weight of liquid explosive nitric ester material adsorbed onto a high proportion of solids. The gelatin compositions range from the so-called "semi-gels" which typically contain from 10 to 20% by weight of liquid explosive nitric ester material, the so-called "low-gels" which typically contain from 20 to 30% by weight of liquid explosive nitric ester material, the so-called "medium gels" which typically contain from 30 to 40% by weight of liquid explosive nitric ester material, the so-called "high gels" which typically contain greater than or equal to 40% by weight of liquid explosive nitric ester material, to the straight dynamites which essentially comprise only gelatinized liquid explosive nitric ester material. Therefore, the dynamite component of the explosive compositions of the present invention also may comprise from as low as 5% up to approximately 100% by weight of liquid explosive nitric ester material.

Solid additives which have most frequently been incorporated into powder and gelatin dynamite compositions, and which may be used in the dynamite compositions of the present invention include oxidizing salts, combustible carbonaceous materials and fillers. Examples of suitable oxidizing salts include the alkali and alkaline earth metal nitrates and ammonium nitrate in both prilled an powdered forms. The preferred oxidizing salts are sodium nitrate and ammonium nitrate. Examples of suitable solid carbonaceous materials include finely divided asphalt, naphthalene, sugar, urea, hexamethylenetetramine, cellulosic materials such as sawdust, wood pulp and wood meal and cereal products such as flours, dextrins and starches. Preferred solid carbonaceous materials include wood meal, flours and starches. Examples of suitable solid fillers include finely divided calcium carbonate, china clay, barium sulfate, sodium chloride, ammonium phosphates and mixtures thereof.

Typically, dynamites contain up to 95% by weight of solid additives onto which the liquid explosive nitric ester material is adsorbed. For example, the gelatin dynamites may range from little or no solid additives in the straight dynamites up to 80 to 90% by weight of solid additives in the semi-gel dynamites. The powder dynamites may contain up to 95% by weight of solid additives. Therefore, the dynamite component of the explosive compsitions of the present invention also may comprise up to 95% by weight of solid additives.

In the preparation of gelatin dynamites the liquid explosive nitric ester material is gelatinized using nitrocellulose or nitrocotton. The type of nitrocellulose or nitrocotton conventionally used in dynamite manufacture may also be used in the preparation of the dynamite component of the explosive compositions of the present invention. Additional conventional thickening agents such as, for example, guar gum may also be added where desirable.

Typically, up to 10% by weight of nitrocellulose may be usded to gelatinize the liquid explosive nitric ester material used in gelatin dynamites and up to 10% by weight of nitrocellulose may be used to gelatinize the liquid explosive nitric ester material used in the dynamite component of the explosive compositions of the present invention. The specific amount of nitrocellulose used will depend to a large extent on the liquid explosive nitric ester content of the dynamite component and the physical properties required for the dynamite-type explosive composition of the invention. However, in general, the amount of nitrocellulose preferred for use ranges fronm 0.1% to 5.0% by weight of the dynamite component.

The dynamite component of the explosive compositions of the present invention may be prepared by any of the methods known in the art for the preparation of dynamites. For example, gelatin dynamites may be prepared by blending the gelatinized liquid explosive nitric ester material and the solid ingredients in a mixer such as a conventional ribbon mixer or planetary mixer to give a uniform composition.

A wide range of emulsion explosive compositions known in the art may be used as the emulsion component of the dynamite-type explosive compositions of the present invention. Suitable emulsion components include those of the water-in-oil type, such as those first described by Bluhm in U.S. Pat. No. 3,447,978 and its equivalents, and the melt-in-oil type, such as those first described by Healy in South African Patent No. 78/2057 and its equivalents.

Emulsion explosives of the water-in-oil type comprise a discontinuous aqueous phase comprising discrete droplets of an aqueous solution of inorganic oxygen-releasing salts, a continuous water-immiscible organic phase throughout which the droplets are dispersed and an emulsifier which forms an emulsion of the droplets of oxidizer salt solution throughout the continuous organic phase.

Suitable oxygen-releasing salts for use in the aqueous phase of the water-in-oil type emulsion component of the compositions of the present invention include the alkali and alkaline earth metal nitrates, chlorates and perchlorates, ammonium nitrate, ammonium chlorate, ammonium perchlorate and mixtures thereof. The preferred oxygen-releasing salts include ammonium nitrate, sodium nitrate and calcium nitrate. More preferably the oxygen-releasing salt comprises ammonium nitrate or a mixture of ammonium nitrate and sodium or calcium nitrate.

Typically, the oxygen-releasing salt of the water-in-oil type emulsion component of the explosive compositions of the present invention comprises from 50 to 95% and preferably from 70 to 90% by weight of the emulsion component. In compositions wherein the oxygen-releasing salts comprise a mixture of ammonium nitrate and sodium nitrate the preferred composition range for such a blend is from 5 to 40 parts of sodium nitrate for every 100 parts of ammonium nitrate. Therefore, in the preferred water-in-oil emulsion component of the compositions of the present invention the oxygen-releasing salt comprises from 70 to 90% by weight (of the emulsion component) ammonium nitrate or a mixture of from 5 to 30% by weight (of the emulsion component) sodium nitrate and from 40 to 85% by weight (of the emulsion component) ammonium nitrate.

In the preparation of the water-in-oil type emulsion component of the explosive compositions of the prsent invention, preferably all of the oxygen-releasing salt is in aqueous solution. Typically, the amount of water employed in the emulsion component of the compositions of the present invention is in the range of from 2 to 30% by weight of the emulsion component. Preferably the amount employed is from 5 to 25%, and more preferably from 10 to 20% by weight of the emulsion component.

The water-immiscible organic phase of the water-in-oil type emulsion component of the compositions of the present invention comprises the continuous "oil" phase of the water-in-oil emulsion and is a fuel. Suitable organic fuels include aliphatic, alicyclic and aromatic compounds and mixtures thereof which are in the liquid state at the formulation temperature. Suitable organic fuels may be chosen from mineral oils, fuel oils, lubricating oils, diesel oils, distillate, kerosene, naphtha, waxes, slack wax, microcrystalline waxes, paraffin waxes, paraffin oils, benzene, toluene, xylenes, dinitrotoluenes, asphaltic materials, polymeric oils such as the low molecular weight polymers of olefins, animal oils, vegetable oils, fish oils, and other mineral, hydrocarbon or fatty oils, and mixtures thereof. Preferred organic fuels include liquid hydrocarbons generally referred to as petroleum distillates or mineral oils such as gasoline, kerosene, fuel oils, lubricating oils and paraffin oils, waxes such as paraffin waxes, slack wax and microcrystalline waxes, and mixtures thereof.

Typically, the organic fuel or continuous phase of the water-in-oil type emulsion component of the explosive compositions of the present invention comprises from 2 to 15% by weight and preferably 5 to 10% by weight of emulsion component.

Suitable emulsifiers for use in the water-in-oil type emulsion component of the compositions of the present invention include those conventional water-in-oil emulsifiers well known in the art for their use in the preparation of emulsion explosive compositions. Examples of such emulsifiers include: sorbitan fatty acid esters such as sorbitan monolaurate, sorbitan monooleate, sorbitan monopalmitate, sorbitan monostearate, sorbitan tristearate and sorbitan sesquioleate; poly(oxyethylene) sorbitan esters such as poly(oxyethylene) sorbitan monooleate and poly(oxyethylene) sorbitan sesquioleate; alkyl- and alkenyl-oxazolines such as 2-heptadecyl-4,4-bis(hydroxymethyl)-2-oxazoline, 2-heptadecyl-4-hydroxymethyl-4-methyl-2-oxazoline, and 2-(8-heptadecenyl)-4,4-bis(hydroxymethyl)-2-oxazoline; salts of fatty acids such as the ammonium, tris(2-hydroxyethyl)ammonium, alkali metal and alkaline earth metal salts of stearic and oleic acids; the mono- and di-glycerides of fatty acids; poly(oxyalkylene) fatty acid esters; alkyl- and alkenyl-imidazolines such as the 2-($C_8$ to $C_{22}$ alkyl)- and 2-($C_8$ to $C_{22}$ alkenyl)-imidazolines; alcohol alkoxylates such as the mono-, di-, tri- and tetraethoxylates of lauryl, oleyl and stearyl alcohols; phenol alkoxylates and alkylphenol alkoxylates; ethylene oxide/propylene oxide block copolymers; alkylsulfonates; alkylarylsulfonates; alkylsulfosuccinates; alkylphosphates and alkenylphosphates such as the fatty phosphate esters; alkylamines and salts thereof such as laurylamine acetate; soyabean lecithin; lanolin derivatives; and mixtures thereof.

Preferred water-in-oil type emulsifiers suitable for use in the water-in-oil type emulsion component of the compositions of the present invention include: the sorbitan fatty acid esters and particularly sorbitan mono-oleate, sorbitan sesquioleate, sorbitan monostearate, sorbitan tristearate, sorbitan monolaurate, and sorbitan monopalmitate; poly(oxyethylene) sorbitan fatty acid esters and particularly poly(oxyethylene) sorbitan mono-oleate; alcohol alkoxylates and particularly poly(oxyethylene) stearyl ether; alkenyloxazolines and particularly 2-(8-heptadecenyl)-4,4-bis(hydroxymethyl)-2-oxazoline; soyabean lecithin; and mixtures thereof.

Typically, the emulsifier used in the water-in-oil type emulsion component of the explosive compositions of the present invention comprises from 0.1 to 5.0% by weight of the emulsion component. In general, it is not necessary to use more than 2.0% by weight of the emulsifier in the water-in-oil type emulsion component of the explosive compositions of the present invention. While higher proportions of emulsifier may be used, for reasons of economy it is desirable to keep the proportion used to a minimum required. The preferred level of the emulsifier is in the range of from 0.3 to 2.0% by weight of the emulsion component.

It is not necessary to incorporate thickening and/or crosslinking agents in the water-in-oil type emulsion component of the explosive compositons of the present invention to achieve stability and water resistance. However, if desired the aqueous phase of the emulsion component of the compositions of the present invention may comprise optional thickening agent(s) which optionally may be crosslinked. The thickening agents, when used in the emulsion component of the compositions of the present invention, are suitably polymeric materials, especially gum materials typified by the galactomannan gums such as locust bean gum or guar gum or derivatives thereof such as hydroxypropyl guar gum. Other useful, but less preferred, gums are the so-called biopolymer gums such as the heteropolysaccharides prepared by the microbial transformation of carbohydrate material, for example the treatment of glucose with plant pathogen of the genus Xanthomonas typified by *Xanthomonas campestris*. Other useful thickening agents include synthetic polymeric materials and in particular synthetic polymeric materials which are derived, at least in part, from the monomer acrylamide.

Typically, the optional thickening agent used in the emulsion component of the compositions of the present invention comprises from 0 to 2.0% by weight of the emulsion component.

As indicated above, when used in the emulsion component of the compositions of the present invention, the thickening agent optionally may be crosslinked. It is convenient for this purpose to use conventional crosslinking agents such as zinc chromate or a dichromate either as a separate entity or as a component of a conventional redox system such as, for example, a mixture of potassium dichromate and potassium antimony tartrate.

Typically, the optional crosslinking agent used in the emulsion component of the compositions of the present invention comprises from 0 to 0.5 and preferably from 0 to 0.1% by weight of the total composition.

If desired, optional thickening and/or crosslinking agents may be incorporated into the dynamite component of the explosive compositions of the present invention either in addition to or as an alternative to incorporation in the emulsion component of the explosive compositions.

Emulsion explosive compositions of the melt-in-oil type comprise a discontinuous phase comprising discrete droplets of a melt or eutectic comprising inorganic oxygen-releasing salts, a continuous organic or fuel phase throughout which the droplets are dispersed and an emulsifier which forms an emulsion of the droplets throughout the continuous organic phase. Melt-in-oil type emulsion explosive compositions are prepared by dispersing the melt or eutectic in molten form in the organic or fuel phase in liquid form. The emulsification step may be carried out at an elevated temperature using a melt or eutectic and/or an organic or fuel phase which is solid or semi-solid at ambient temperatures. Therefore, at ambient temperatures the melt-in-oil type emulsion composition may comprise a solid or semi-solid which will only flow when subjected to some pressure.

The melt or eutectic phase of the melt-in-oil type emulsion component of the compositions of the present invention comprises a melt or eutectic containing one or more oxygen-releasing salts. The melt comprises an inorganic oxygen-releasing salt, suitably and preferably ammonium nitrate, in admixture with at least one melt-soluble compound which forms a melt with the oxygen-releasing salt, the melt having a melting point which is lower than the melting point of the oxygen-releasing salt.

Oxygen-releasing salts for use in the melt or eutectic phase of the melt-in-oil type component of the compositions of the present invention may be selected from the alkali and alkaline earth metal nitrates, chlorates and perchlorates, ammonium nitrate, ammonium chlorate, ammonium perchlorate and mixtures thereof. More preferably the oxygen-releasing salt comprises ammonium nitrate or a mixture of ammonium nitrate and sodium or calcium nitrate.

The melt-soluble compound for use in the melt or eutectic phase of the melt-in-oil type emulsion component of the compositions of the present invention may be selected from: inorganic salts, including oxygen-releasing salts such as the alkali and alkaline earth metal nitrates, lead nitrate, silver nitrate and mixtures thereof; and fuels including alcohols such as methanol, glycols such as ethylene glycol, polyols such as glycerol, mannitol, sorbitol and pentaerythritol, carbohydrates such as sugars, starches and dextrins, carboxylic acids and the salts thereof such as formic acid, acetic acid, glycine, chloroacetic acid glycolic acid, succinic acid, tartaric acid, adipic acid, ammonium formate, sodium formate, sodium acetate and ammonium acetate, amines and the salts thereof such as methylamine, hexamethylenetetramine, methylamine nitrate, ethanolamine, nitrate, triethylamine nitrate, hydrazine mononitrate and ethylenediamine dinitrate, thiocyanates such as ammonium thiocyanate, amides such as formamide, acetamide, urea, thiourea and dicyandiamide, and other nitrogenous substances such as urea nitrate, nitroguanidine and guanidine nitrate. The melt-soluble compounds should be capable of forming a miscible melt with the oxygen-releasing salt, preferably with ammonium nitrate, the melt having a melting point which is lower than the melting point of the oxygen-releasing salt. Preferred melt-soluble compounds include alkali and alkaline earth metal nitrates such as sodium nitrate, amides such as urea, amine nitrates such as methylamine nitrate, hydrazine mononitrate, ethanolamine nitrate and triethylamine nitrate, and mixtures thereof.

Typically the melt or eutectic phase of the melt-in-oil type emulsion component of the compositions of the present invention comprises from 75 to 95 percent by weight of the emulsion component.

The organic fuel or continuous phase of the melt-in-oil type emulsion component of the compositions of the present invention comprises the continuous "oil" phase of the melt-in-oil emulsion and is a fuel. Suitable organic fuels include aliphatic, alicyclic and aromatic compounds and mixtures thereof which are in the liquid state at the formulation temperature. Suitable organic fuels may be chosen from mineral oils, fuel oils, lubricating oils, diesel oils, distillate, kerosene, naphtha, waxes, microcrystalline waxes, paraffin waxes, paraffin oils, benzene, toluene, xylenes, dinitrotoluenes, asphaltic materials, polymeric oils such as the low molecular weight polymers of olefins, animal oils, vegetable oils, fish oils and other mineral hydrocarbon or fatty oils, and mixtures thereof. Preferred organic fuels include liquid hydrocarbons, generally referred to as petroleum distillates or mineral oils, such as gasoline, kerosene, fuel oils, lubricating oils and paraffin oils, waxes such as paraffin waxes, slack wax and microcrystalline waxes, and mixtures thereof.

Typically, the organic fuel or continuous phase of the melt-in-oil type emulsion component of the explosive composition of the present invention comprises from 2.5 to 25% by weight, and preferably 5 to 12% by weight of the emulsion component.

The emulsifiers suitable for use in the melt-in-oil type emulsion component of the compositions of the present invention generally include those conventional water-in-oil emulsifiers well known in the art for their use in the preparation of water-in-oil emulsion explosive compositions. Examples of such emulsifiers include those previously described herein for use in the water-in-oil type emulsion component of the compositions of the present invention.

Examples of preferred emulsifiers suitable for use in the melt-in-oil type emulsion component of the compositions of the present invention include those previously described herein for use in the water-in-oil type emulsion component of the compositions of the present invention.

Typically, the emulsifier used in the melt-in-oil type emulsion component of the explosive compositions of the present invention comprises from 0.5 to 10% by weight of the emulsion component. The preferred level of the emulsifier is in the range of from 1.0 to 5.0% by weight of the emulsion component.

The emulsion component of the explosive compositions of the present invention may also comprise a discontinuous gaseous phase. The gaseous phase may be incorporated into the compositions of the present invention as fine gas bubbles dispersed throughout the composition, hollow particles which are often referred to as microballoons, porous particles, or mixtures thereof. A discontinuous phase of fine gas bubbles may be incorporated into the compositions of the present invention by mechanical agitation, injection or bubbling the gas through the composition, or by in situ generation of the gas by chemical means. Suitable chemicals for the in situ generation of gas bubbles include peroxides such as, for example, hydrogen peroxide, nitrites such as, for example, sodium nitrite, nitrosoamines, such as, for example N,N'-dinitrosopentamethylenetetramine, alkali metal borohydrides such as, for example, sodium borohydride, and carbonates such as sodium carbonate. Preferred chemicals for the in situ generation of gas bubbles are nitrous acid and its salts which decompose under conditions of acid pH to produce gas bubbles. Thiourea may be used to accelerate the decomposition of a nitrite gassing agent. Examples of suitable hollow particles include small hollow microspheres of resinous materials such as phenol-formaldehyde and urea-formaldehyde. Examples of suitable porous materials include expanded materials such as polystyrene.

If desired, a discontinuous gaseous phase may be incorporated into the dynamite component of the explosive compositions of the present invention either in addition to or as an alternative to incorporation in the emulsion component of the explosive compositions.

Typically, the optional discontinuous gaseous phase, when used in the form of hollow particles (microballoons) or porous particles in either the emulsion component or the dynamite component of the compositions of the present invention, comprises from 0 to 6 and preferably from 0 to 3 percent by weight of the emulsion component and/or the dynamite component.

If desired other, optional fuel materials, hereinafter referred to as secondary fuels, may be incorporated into the emulsion component of the compositions of the present invention, in addition to the organic fuel phase. Examples of such secondary fuels include finely divided solids, and organic liquids. Examples of solid secondary fuels include finely divided elements such as sulfur and aluminium; and carbonaceous materials such as gilsonite, comminuted coke or charcoal, carbon black, resin acids such as abietic acid, sugars such as glucose or dextrose and other vegetable products such as starch, nut meal, grain meal and wood pulp. Examples of organic liquids include alcohols such as methanol, glycols such as ethylene glycol, amides such as formamide and amines such as methylamine.

Typically, the optional secondary fuel used in the emulsion component of the compositions of the present invention comprises from 0 to 30% by weight of the emulsion component.

If desired, optional fuel materials, and in particular finely divided carbonaceous solids, may be incorporated into the dynamite component of the explosive compositions of the present invention either in addition to or as an alternative to incorporation in the emulsion component of the explosive compositions.

If desired, one or more surface active agents, such as for example the emulsifiers hereinbefore described, optionally may be incorporated into the dynamite component of the explosive compositions of the present invention.

Typically, the optional surface active agent or emulsifier used in the dynamite component of the compositions of the present invention comprises from 0 to 10 and preferably 0 to 2 percent by weight of the dynamite component.

The water-in-oil emulsion component of the explosive compositions of the present invention may be prepared by a number of methods. Preferably the compositions are prepared by: dissolving the oxygen-releasing salts(s) in the aqueous phase at a temperature above the fudge point of the salt solution, preferably at a temperature in the range of from 25° to 110° C.; preparing a mixture, preferably a solution, of the water-in-oil type emulsifier and any optional organic phase soluble components in the water-immiscible organic phase, preferably at the same temperature as the salt solution; adding the aqueous phase to the organic phase with rapid mixing to produce the water-in-oil type emulsion component of the explosive composition of the present invention; mixing until the formation is uniform; and then mixing in any solid ingredients or gaseous component. Possible variations of this general procedure will be evident to those skilled in the art of the preparation of emulsion explosive compositions.

The melt-in-oil type emulsion component of the explosive compositions of the present invention may be prepared by a number of methods. Preferably the emulsion composition is prepared by: forming a melt of the oxygen-releasing salt(s) and the melt-soluble compound(s), preferably at a temperature in the range from 25° to 130° C.; preparing a liquid mixture of the organic or fuel phase and the emulsifiying agent, preferably at or around the same temperature as the melt; mixing the melt phase and the organic or fuel phase with agitation to produce the melt-in-oil type emulsion component of the present invention; mixing until the formation is uniform; and then mixing in any solid ingredients or gaseous component. Possible variations of this general procedure will be evident to those skilled in the art of the preparation of emulsion explosive compositions.

As hereinbefore indicated, dynamites generally contain a mixture of a gelatinized liquid explosive nitric ester material and solid additives such as oxygen-releasing salts and carbonaceous fuels. The emulsion component of the explosive compositions of the present invention also comprises oxygen-releasing salt and carbonaceous fuel. Therefore, in one option or variation the solid additives content of the dynamite component of the explosive compositions of the present invention may, in certain circumstances, be partially or completely replaced by the emulsion component of the composition.

The explosive compositions of the present invention may be prepared by mixing together the liquid explosive nitric ester material of the dynamite component, any additives to be included in the dynamite component, and the emulsion component in a mixer, such as, for example, a conventional ribbon mixer or planetary mixer, to give a uniform mixture. The uniform mixture may then be shaped into cartridges using a conventional extruder-type or roller-type cartridging machine. In a variation of this process a pre-prepared dynamite may be used as the dynamite component and mixed with the emulsion component to give a uniform mixture which may then be shaped into cartridges. Possible variations of this general procedure will be evident to those skilled in the art of the preparation of explosive compositions.

Accordingly in a further embodiment the invention provides a process for the preparation of a dynamite-type explosive composition comprising a dynamite component which comprises at least one liquid explosive nitric ester and an emulsion component which comprises an oxygen-releasing salt phase, an organic phase and an emulsifier, which process comprises blending said dynamite component and said emulsion component together to form a uniform composition.

It is completely unexpected to find that the amount of liquid explosive nitric esters used in dynamite compositions can be reduced by incorporating an emulsion of an oxidizing-salt phase and an organic fuel phase in the composition, without adversely affeccting either the performance or physical properties of the composition. Clearly it would have been expected that any reduction of the self-explosive organic, high explosive, liquid nitric ester content of dynamite would have progressively reduced the performance of the dynamite. However, not only has it been found that the liquid nitric ester can be reduced without adversely affecting performance, compositions of the present invention show improved performance over prior art dynamite compositions containing considerably more liquid explosive nitric ester. Examples of such improved performance include higher energy release and better rock fragmentation.

Apart from the economic advantages of lower liquid nitric ester content and improved performance, the compositions of the present invention have a number of other advantages over prior art dynamite compositions. For example, the compositions of the present invention have lower impact sensitivity and are therefor safer to handle than comparable prior art dynamite compositions. The compositions also show reduced noxious fumes after detonation, a very important advantage for applications in confined spaces such as found in mines, trenches and tunnels. The lower liquid nitric ester content of the compositions of the present invention also means that the compositions give of less nitric ester fumes on storage which results in an important improvement in the working environment.

It will be evident to those skilled in the art that the dynamite-type explosive compositions of the present invention are eminently suitable for use as replacements for conventional prior art dynamites. Moreover, it should be noted that certain compositions of the present invention, and particularly those in which the oxygen-releasing salt and carbonaceous fuel solid additives of the dynamite component have been partially, or preferably essentially completely, replaced by the emulsion component, may be used as explosive boosters in place of pentolite. Such compositions of the invention have a high velocity of detonation, generate high pressures on detonation, show a higher sensitivity to detonation than does pentolite and have considerable economic advantages over pentolite.

The invention is now illustrated by, but is not limited to, the following Examples in which all parts and percentages are expressed on a weight basis unless otherwise specified.

EXAMPLES 1–22

A water-in-oil emulsion composition was prepared by adding, with rapid stirring, a hot (70° C.) aqueous solution of ammonium nitrate (686 parts) and sodium nitrate (136 parts) in water (115 parts) to a hot (70° C.) mixture of paraffin oil, or a paraffin oil-paraffin wax mixture, (49 parts) and sorbitan mono-oleate (14 parts). On completion of the mixing the mixture was allowed to cool to give a stable water-in-oil emulsion.

The explosive compositions of the present invention were prepared by mixing together, in a conventional ribbon mixer, the ingredient listed in Table 1 in the proportions set out in that Table. Mixing was continued until a uniform composition had been obtained and then the explosive composition was extruded into 25×200 mm paper shells using a cartridging machine conventionally used for the manufacture of explosives. Details of the properties of the compositions are set out in Table 2.

TABLE 1

Compositions of the Invention

| Example No | Ingredients (parts by weight) | | | | | | | | |
|---|---|---|---|---|---|---|---|---|---|
| | EGDN | NG | NC | AN | WF | S | PS | PB | EC |
| 1 | 160 | — | 6 | 555 | 70 | 4 | 5 | — | 200 |
| 2 | 200 | — | 7.5 | 648.5 | 70 | 4 | — | — | 70 |
| 3 | 152.4 | — | 6 | 534 | 67 | 3.6 | — | — | 237 |
| 4 | 152.4 | — | 6 | 529 | 67 | 3.6 | — | 5 | 237 |
| 5 | 185.1 | — | 6.3 | 601 | 65 | 3.6 | — | — | 139 |
| 6 | 132 | — | 3.9 | 510 | 63.7 | 3.5 | — | 4.9 | 282 |
| 7 | 180.3 | — | 6.6 | 493.7 | 65.1 | 4 | — | — | 250.3 |
| 8 | — | 180.3 | 6.6 | 493.7 | 65.1 | 4 | — | — | 250.3 |
| 9 | 130 | — | 4.8 | 509 | 63.6 | 3.6 | — | — | 289 |
| 10 | 130 | — | 4.8 | 499 | 63.6 | 3.6 | — | 10 | 289 |
| 11 | 152 | — | 6 | 548 | 45 | 4 | 5 | — | 240 |
| 12 | 152 | — | 6 | 548 | 40 | 4 | 10 | — | 240 |
| 13 | 152 | — | 6 | 547 | 45 | — | 10 | — | 240 |
| 14 | 170 | — | 6 | 605 | 60 | 4 | 5 | — | 150 |
| 15 | 170 | — | 6 | 565 | 45 | 4 | 10 | — | 200 |
| 16 | 170 | — | 6 | 525 | 30 | 4 | 15 | — | 250 |
| 17 | 149 | — | 6 | 536 | 44 | 4 | 5 | — | 255 |
| 18 | 162 | — | 6 | 538 | 43 | 4 | 10 | — | 237 |
| 19 | 155 | — | 5.5 | 485.5 | 30 | 4 | 10 | — | 310 |
| 20 | 155 | — | 5.5 | 485.5 | 30 | 4 | 10 | — | 310 |
| 21 | 170 | — | 6 | 445 | 25 | 4 | 10 | — | 340 |
| 22 | 132 | — | 5 | 492 | 37 | 4 | 10 | — | 320 |

Code for TABLE 1
EGDN — ethylene glycol dinitrate
NG — nitroglycerine
NC — nitrocellulose
AN — ammonium nitrate
WF — wheat flour
S — sorbitan mono-oleate
PS — polystyrene
PB — phenolic microballoons
EC — emulsion component
WM — wood meal
SN — sodium nitrate
SC — sodium chloride
ST — starch
BA — barytes
PSE — poly(oxyethylene)stearyl ether
PN — potassium nitrate
WP — wood pulp
SS — sorbitan sesquioleate
NHCN — Norsk Hydro calcium nitrate
PO — paraffin oil
PW — paraffin wax
MW — microcrystalline wax
SW — slack wax
CN — calcium nitrate
AP — ammonium perchlorate
MAN — methylamine nitrate
EAN — ethanolamine nitrate
EDDN — ethylenediamine dinitrate
HMN — hydrazine mononitrate
TEAN — triethylamine nitrate
UR — urea
DNT — dinitrotoluene
TNT — trinitrotoluene

TABLE 2

Properties of the Compositions of the Invention

| Example No | Property | | | |
|---|---|---|---|---|
| | ρ | VOD | ADC | SEN |
| 1 | 1.36 | 3.5 | 80 | 8 |
| 2 | 1.29 | — | 60 | 8 |
| 3 | 1.40 | 2.8 | 20 | 8 |
| 4 | 1.35 | 3.5 | 80 | 2 |
| 5 | 1.30 | 3.6 | 60 | 2 |
| 6 | 1.32 | 2.9 | 40 | 8 |
| 7 | 1.35 | 2.6 | 20 | 6 |
| 8 | 1.37 | 2.8 | 60 | 8 |
| 9 | 1.37 | 2.4 | — | 6 |
| 10 | 1.33 | 3.0 | — | 6 |
| 11 | 1.32 | 3.4 | 40 | 2 |
| 12 | 1.30 | — | 20 | 3 |
| 13 | 1.33 | 2.6 | 20 | 2 |
| 14 | 1.28 | 3.5 | 20 | 2 |
| 15 | 1.25 | 3.6 | 20 | 2 |
| 16 | 1.10 | 3.6 | 60 | 2 |
| 17 | 1.35 | 3.4 | 20 | 2 |
| 18 | 1.23 | 3.9 | 80 | 2 |
| 19 | 1.23 | 4.1 | 60 | 2 |
| 20 | 1.27 | 3.7 | 60 | 2 |
| 21 | 1.21 | 4.5 | 80 | 2 |
| 22 | 1.25 | 3.8 | 20 | 2 |

Code for TABLE 2
ρ — bulk density expressed in grams per cubic centimeter
VOD — velocity of detonation expressed in meters per second
ADC — Ardeer Double Cartridge or Gap Test; gap distance expressed in millimeters.
SEN — detonator for which sensitivity of explosive composition has been confirmed.

COMPARATIVE EXAMPLES A–D

Four standard dynamite compositions, representing semi-gel, low-gel, medium-gel and high-gel dynamites, were prepared by mixing together the ingredients listed in Table 3 in the proportions set out in that Table. Mixing was continued until a uniform composition had been obtained and then the explosive composition was extruded into 25×200 mm paper shells using a cartridging machine conventionally used for the manufacture of explosives. The dynamite compositions were then tested so that their properties could be compared with the properties of the compositions of the present invention. Details of the properties of the dynamite compositions are set out in Table 4.

TABLE 3

Comparative Examples

| Comparative Example | Ingredients (parts by weight) | | | | | | |
|---|---|---|---|---|---|---|---|
| | EGDN | NG | NC | AN | WF | S | WM |
| A | 147 | — | 3 | 795 | 10 | 3 | 42 |
| B | 265 | — | 12 | 642 | 70 | 1 | 10 |
| C | 325 | — | 15 | 590 | 54 | 1 | 15 |
| D | 400 | — | 21 | 510 | 20 | 1 | 48 |

For Code see TABLE 1

TABLE 4

Properties of the Comparative Compositions

| Comparative Example No | Property | | | |
|---|---|---|---|---|
| | ρ | VOD | ADC | SEN |
| A | 1.25 | 2.4 | 180 | 6 |
| B | 1.40 | 2.9 | 80 | 6 |
| C | 1.45 | 3.2 | 100 | 6 |
| D | 1.45 | 3.5 | 150 | 6 |

For Code see TABLE 2

EXAMPLES 23 TO 28

These Examples illustrate powder type explosive compositions of the invention.

A water-in-oil emulsion composition was prepared as described for Examples 1 to 22, the oil phase comprising a mixture of 20% paraffin oil, 40% paraffin wax and 40% microcrystalline wax, by weight. This emulsion was then used in the preparation of a series of powder type explosive compositions of the present invention following the procedure described for Examples 1 to 22. The ingredients and their proportions are set out in Table 5. Details of the properties of the compositions are set out in Table 6. The compositions were packed in 32×200 mm paper cartridges for explosive testing.

TABLE 5

| Example No | Powder Type Compositions of the Invention — Ingredients (parts by weight) | | | | | | | | |
|---|---|---|---|---|---|---|---|---|---|
| | EGDN | NG | NC | AN | SN | SC | WM | WF | EC |
| 23 | 59 | 88 | 1.5 | 602 | 130.5 | — | — | 99 | 20 |
| 24 | 40 | 60 | 1 | 602 | 150.5 | — | — | 99 | 47.5 |
| 25 | 24 | 36 | — | 604 | — | 204 | 94 | — | 38 |
| 26 | 20 | 30 | — | 820 | — | — | 80 | — | 50 |
| 27 | 24 | 36 | 1 | 820 | — | — | 79 | — | 40 |
| 28 | 28 | 42 | — | 820 | — | — | 80 | — | 30 |

For Code see TABLE 1

TABLE 6

| Example No | Properties of the Powder Type Compositions of the Invention — Property | | |
|---|---|---|---|
| | ρ | VOD | SEN |
| 23 | 1.0 | 1.9 | 6 |
| 24 | 0.9 | 2.1 | 6 |
| 25 | 0.95 | 1.8 | 6 |
| 26 | 0.9 | 2.3 | 6 |
| 27 | 0.9 | 2.2 | 6 |
| 28 | 0.92 | 2.2 | 6 |

For Code see TABLE 1

EXAMPLES 29 TO 37

These Examples illustrate semi-gel type explosive compositions of the invention.

A series of semi-gel type explosive compositions of the present invention were prepared following the same procedure as that described for Examples 1 to 22. The emulsion component used was the same as that described for Examples 23 to 28. The ingredients and their properties are set out in Table 7. Details of the properties of the compositions are set out in Table 8. The compositions were packed in 29×200 mm paper cartridges for explosive testing.

TABLE 7

| Example No | Semi-gel Type Compositions of the Invention — Ingredients | | | | | | |
|---|---|---|---|---|---|---|---|
| | EGDN | NG | NC | AN | WM | ST | EC |
| 29 | 40 | 60 | 3 | 796 | 52 | 2 | 47 |
| 30 | 40 | 60 | 2 | 796 | 39 | 16 | 47 |
| 31 | 40 | 60 | 2 | 808 | 58 | 9 | 23 |
| 32 | 28 | 42 | 2 | 796 | 52 | 3 | 77 |
| 33 | 28 | 42 | 1.5 | 796 | 38.5 | 17 | 77 |
| 34 | 28 | 42 | 1.5 | 806 | 58 | 11.5 | 53 |
| 35 | 40 | 60 | 3 | 758 | 50 | 2 | 87 |
| 36 | 40 | 60 | 2 | 758 | 37 | 16 | 87 |

TABLE 7-continued

| Example No | Semi-gel Type Compositions of the Invention — Ingredients | | | | | | |
|---|---|---|---|---|---|---|---|
| | EGDN | NG | NC | AN | WM | ST | EC |
| 37 | 40 | 60 | 2 | 751 | 55 | 9 | 83 |

For Code see TABLE 1

TABLE 8

| Example No | Properties of the Semi-gel Type Compositions of the Invention — Property | | | |
|---|---|---|---|---|
| | ρ | VOD | ADC | SEN |
| 29 | 1.0 | 2.6 | 120 | 3 |
| 30 | 1.0 | 2.5 | 120 | 3 |
| 31 | 1.0 | 2.5 | 120 | 3 |
| 32 | 1.1 | 2.6 | 100 | 3 |
| 33 | 1.1 | 2.7 | 100 | 2 |
| 34 | 1.0 | 2.6 | 100 | 2 |
| 35 | 1.1 | 2.8 | 80 | 2 |
| 36 | 1.1 | 2.9 | 80 | 3 |
| 37 | 1.1 | 2.9 | 80 | 3 |

For Code see TABLE 2

EXAMPLES 38 TO 51

These Examples illustrate gel type explosive compositions of the invention in which the solid additives content of the dynamite component is essentially completely replaced by the emulsion component.

A series of gel type explosive compositions of the present invention were prepared following the same procedure as that described for Examples 1 to 22. The emulsion component used was the same as that described for Examples 23 to 28. The ingredients and their proportions are set out in Table 9. Details of the properties of the compositions are set out in Table 10. The compositions were packed in 32×200 mm paper cartridges for explosive testing.

TABLE 9

| Example No | Gel Type Compositions of the Invention — Ingredients | | | | | | |
|---|---|---|---|---|---|---|---|
| | EGDN | NG | NC | BA | PS | PB | EC |
| 38 | 860 | — | 76 | 10 | 5 | — | 49 |
| 39 | — | 860 | 76 | 10 | — | 5 | 49 |
| 40 | 774 | 86 | 76 | 10 | 5 | — | 49 |
| 41 | 774 | 86 | 76 | 10 | — | 5 | 49 |
| 42 | 774 | 86 | 76 | 10 | — | — | 54 |
| 43 | 540 | 60 | 52 | 50 | — | 5 | 293 |
| 44 | 600 | — | 52 | 50 | 5 | — | 293 |
| 45 | — | 600 | 52 | 50 | — | 5 | 293 |
| 46 | 495 | 55 | 48 | 50 | — | 5 | 347 |
| 47 | 432 | 48 | 42 | 23 | 5 | — | 450 |
| 48 | 480 | — | 42 | 23 | — | 5 | 450 |
| 49 | 387 | 43 | 38 | 77 | 5 | — | 450 |
| 50 | 342 | 38 | 33 | 132 | 5 | — | 450 |
| 51 | 380 | — | 33 | 132 | — | 5 | 450 |

For Code see TABLE 1

TABLE 10

| Example No | Properties of the Gel Type Compositions of the Invention — Property | | |
|---|---|---|---|
| | ρ | VOD | SEN |
| 38 | 1.45 | 7.6 | 2 |
| 39 | 1.46 | 7.6 | 2 |
| 40 | 1.45 | 7.55 | 2 |
| 41 | 1.44 | 7.4 | 2 |
| 42 | 1.49 | 7.9 | 2 |
| 43 | 1.47 | 7.6 | 2 |
| 44 | 1.47 | 7.6 | 2 |

TABLE 10-continued

| Example No | Properties of the Gel Type Compositions of the Invention: Property ρ | VOD | SEN |
|---|---|---|---|
| 45 | 1.45 | 7.4 | 2 |
| 46 | 1.48 | 7.4 | 2 |
| 47 | 1.45 | 7.4 | 2 |
| 48 | 1.44 | 7.2 | 2 |
| 49 | 1.41 | 6.8 | 2 |
| 50 | 1.41 | 6.8 | 3 |
| 51 | 1.40 | 6.1 | 2 |

For Code see TABLE 2

EXAMPLES 52–56

These examples illustrate explosive compositions of the present invention comprising an emulsion component containing aluminium powder as a secondary fuel and phenolic microballoons as a discontinuous gaseous phase.

A water-in-oil emulsion composition was prepared from ammonium nitrate (620 parts), sodium nitrate (148 parts), water (109 parts), oil phase (39 parts comprising 20% paraffin oil, 40% paraffin wax and 40% microcrystalline wax) and sorbitan sesquioleate (14 parts) following the procedure described for Examples 1 to 22. On completion of the emulsification aluminium powder (40 parts) and phenolic microballoons (30 parts) were blended into the emulsion. This emulsion was then used in the preparation of a series of explosive compositions of the present invention following the procedure described for Examples 1 to 22. The ingredients and their proportions are set out in Table 11. Details of the properties of the compositions are set out in Table 12. The compositions were packed in 25×200 mm paper cartridges for explosive testing.

TABLE 11

Compositions of the Invention in which the Emulsion Contains a Secondary Fuel and a Discontinuous Gaseous Phase

| Example No | Ingredients (parts by weight): EGDN | NC | AN | ST | PS | PSE | EC |
|---|---|---|---|---|---|---|---|
| 52 | 132 | 5 | 497 | 37 | 5 | 4 | 320 |
| 53 | 149 | 6 | 536 | 44 | 6 | 4 | 255 |
| 54 | 155 | 5.5 | 490.5 | 30 | 5 | 4 | 310 |
| 55 | 162 | 6 | 543 | 43 | 5 | 4 | 237 |
| 56 | 170 | 6 | 450 | 25 | 5 | 4 | 340 |

For Code see TABLE 1

TABLE 12

Properties of Compositions of the Invention in which the Emulsion Contains a Secondary Fuel and a Discontinuous Gaseous Phase

| Example No | Property ρ | VOD | ADC | SEN |
|---|---|---|---|---|
| 52 | 1.25 | 3.8 | 20 | 2 |
| 53 | 1.35 | 3.4 | 20 | 2 |
| 54 | 1.23 | 4.1 | 60 | 2 |
| 55 | 1.23 | 3.9 | 80 | 2 |
| 56 | 1.21 | 4.5 | 80 | 2 |

For Code see TABLE 2

EXAMPLES 57 TO 63

These Examples illustrate explosive compositions of the invention containing a range of different emulsifiers in both the dynamite component and the emulsion component.

A series of explosive compositions of the present invention were prepared following the same procedure as that described for Examples 1 to 22. The emulsion component used was essentially the same as that described for Examples 23 to 28 with the exception that a different emulsifier was used in the emulsion component of each of the Example compositions. The ingredients and their proportions are as follows: ethylene glycol dinitrate (155 parts); nitrocotton (5.5 parts); ammonium nitrate (485.5 parts); starch (30 parts); polystyrene beads (10 parts); surfactant (4 parts); and emulsion (310 parts). The surfactant used in each of the Example compositions was the same as that used as the emulsifier in the emulsion component of each Example composition and is detailed in Table 13 below. Details of the properties of the compositions are set out in Table 14. The compositions were packed in 25×200 mm paper cartridges for explosive testing.

TABLE 13

Compositions of the Invention Containing a Range of Different Emulsifiers

| Example No | Emulsifier/Surfactant |
|---|---|
| 57 | 2-(8-Heptadecenyl)-4,4-bis(hydroxymethyl-2-oxazoline |
| 58 | Sorbitan monostearate |
| 59 | Polyoxyethylene sorbitan mono-oleate |
| 60 | Sorbitan monolaurate |
| 61 | Sorbitan monopalmitate |
| 62 | Poly(oxyethylene) stearyl ether |
| 63 | Sorbitan tristearate |

TABLE 14

Properties of Compositions of the Invention Containing a Range of Different Emulsifiers

| Example No | Property ρ | VOD | ADC | SEN |
|---|---|---|---|---|
| 57 | 1.23 | 3.9 | 80 | 2 |
| 58 | 1.23 | 4.0 | 60 | 2 |
| 59 | 1.27 | 3.7 | 60 | 2 |
| 60 | 1.24 | 3.8 | 60 | 2 |
| 61 | 1.22 | 3.7 | 80 | 2 |
| 62 | 1.22 | 3.9 | 60 | 2 |
| 63 | 1.21 | 4.5 | 80 | 2 |

For Code see TABLE 2

EXAMPLES 64–84

These Examples illustrate explosive compositions of the invention comprising emulsion components containing a range of oxygen-releasing salts and sensitizers.

A series of explosive compositions of the present invention were prepared following essentially the same procedure as that described for Examples 1 to 22. The ingredients and their proportions in each of the Example compositions of the invention are set out in Table 15. The ingredients and their proportions in the emulsion component of each of the Example compositions are set out in Table 16. Details of the properties of the compositions are set out in Table 17. The compositions were packed in 25×200 mm paper cartridges for explosive testing.

TABLE 15

| Example No | Compositions of the Invention Containing a Range of Different Emulsion Components — Ingredients (parts by weight) | | | | | | | | | |
|---|---|---|---|---|---|---|---|---|---|---|
| | EGDN | NC | AN | SN | PN | ST | WP | S | PB | EC |
| 64 | 152 | 6 | 510 | 20 | — | 52 | 15 | 4 | 5 | 236 |
| 65 | 152 | 6 | 490 | 40 | — | 52 | 15 | 4 | 5 | 236 |
| 66 | 152 | 6 | 470 | 60 | — | 52 | 15 | 4 | 5 | 236 |
| 67 | 152 | 6 | 510 | — | 20 | 62 | 5 | 4 | 5 | 236 |
| 68 | 152 | 6 | 490 | — | 40 | 62 | 5 | 4 | 5 | 236 |
| 69 | 152 | 6 | 470 | — | 60 | 62 | 5 | 4 | 5 | 236 |
| | EGDN | NG | NC | AN | ST | S | SS | PS | PB | EC |
| 70 | 62 | 93 | 4 | 490 | 42 | 4 | — | 5 | — | 300 |
| 71 | 62 | 93 | 4 | 487 | 47 | 2 | — | 5 | — | 300 |
| 72 | 56 | 84 | 4 | 485 | 42 | 4 | — | 5 | — | 320 |
| 73 | 68 | 102 | 5 | 470 | 51 | 2 | — | 2 | — | 300 |
| 74 | 60.8 | 91.2 | 6 | 530 | 67 | 4 | — | — | 5 | 236 |
| 75 | 60.8 | 91.2 | 6 | 530 | 67 | 4 | — | — | 5 | 236 |
| 76 | 74 | 111 | 6.3 | 596 | 65 | 3.7 | — | — | 5 | 139 |
| 77 | 162 | 18 | 6 | 483 | 65 | — | 5 | — | 11 | 250 |
| 78 | 162 | 18 | 6 | 483 | 65 | — | 5 | — | 11 | 250 |
| 79 | 162 | 18 | 6 | 483 | 65 | — | 5 | — | 11 | 250 |
| 80 | 162 | 18 | 6 | 483 | 65 | — | 5 | — | 11 | 250 |
| 81 | 162 | 18 | 6 | 483 | 65 | — | 5 | — | 11 | 250 |
| 82 | 162 | 18 | 6 | 483 | 65 | — | 5 | — | 11 | 250 |
| 83 | 162 | 18 | 6 | 483 | 65 | — | 5 | — | 11 | 250 |
| 84 | 162 | 18 | 6 | 483 | 65 | — | 5 | — | 11 | 250 |

For Code see TABLE 1

TABLE 16

| Example No | Emulsion Component Ingredients (parts by weight) — Emulsion Components Used in Examples No 64 to 69 | | | | | | | | |
|---|---|---|---|---|---|---|---|---|---|
| | AN | SN | NHCN | $H_2O$ | PO | PW | MW | SW | S |
| 64 | 686 | 136 | — | 115 | 49 | — | — | — | 14 |
| 65 | 686 | 136 | — | 115 | 10 | 19.5 | 19.5 | — | 14 |
| 66 | 686 | 136 | — | 115 | — | — | — | 49 | 14 |
| 67 | 705 | — | 141 | 97 | 41 | — | — | — | 16 |
| 68 | 705 | — | 141 | 97 | 11 | 15 | 15 | — | 16 |
| 69 | 705 | — | 141 | 97 | — | — | — | 41 | 16 |
| | Emulsion Components Used in Examples No 66 to 84 | | | | | | | | | | | |
| | AN | SN | CN | AP | MAN | EAN | EDDN | $H_2O$ | S | SS | PO | PW |
| 70 | 697 | — | — | — | 101 | — | — | 147 | 20 | — | 20 | 15 |
| 71 | 678 | — | — | — | — | 113 | — | 154 | 20 | — | 20 | 15 |
| 72 | 430 | 100 | — | — | 300 | — | — | 120 | 20 | — | 20 | 10 |
| 73 | 480 | 100 | — | 50 | 200 | — | — | 120 | 20 | — | 20 | 10 |
| 74 | 430 | 100 | — | — | 300 | — | — | 120 | 20 | — | 20 | 10 |
| 75 | 480 | 100 | — | 50 | 200 | — | — | 120 | 20 | — | 20 | 10 |
| 76 | 629 | 100 | — | — | — | — | 101 | 120 | 20 | — | 20 | 10 |
| 77 | 632 | 147 | 36 | — | — | — | — | 125 | — | 15 | 45 | — |
| 78 | 547 | 145 | 45 | — | — | — | — | 180 | — | 25 | 45 | — |
| 79 | 506 | 144 | 101 | — | — | — | — | 169 | — | 26 | 54 | — |
| 80 | 446 | 126 | 200 | — | — | — | — | 148 | — | 25 | 55 | — |
| 81 | 446 | 126 | 200 | — | — | — | — | 148 | — | 25 | 20 | 25 |
| 82 | 408 | 115 | 251 | — | — | — | — | 136 | — | 26 | 64 | — |
| 83 | 355 | 100 | 337 | — | — | — | — | 118 | — | 25 | 65 | — |
| 84 | 632 | 147 | 36 | — | — | — | — | 125 | — | 15 | — | 45 |

For Code see TABLE 1

TABLE 17

| Example No | Properties of Compositions of the Invention Containing a Range of Different Emulsion Components — Property: ρ | VOD | ADC | SEN |
|---|---|---|---|---|
| 64 | 1.35 | 3.6 | 60 | 2 |
| 65 | 1.34 | 3.8 | 80 | 2 |
| 66 | 1.35 | 3.8 | 80 | 2 |
| 67 | 1.36 | 3.4 | 60 | 2 |
| 68 | 1.35 | 3.4 | 80 | 2 |
| 69 | 1.35 | 3.8 | 80 | 2 |
| 70 | 1.35 | 4.3 | 60 | 2 |

TABLE 17-continued

| Example No | Properties of Compositions of the Invention Containing a Range of Different Emulsion Components — Property: ρ | VOD | ADC | SEN |
|---|---|---|---|---|
| 71 | 1.34 | 4.0 | 60 | 2 |
| 72 | 1.31 | 4.0 | 60 | 2 |
| 73 | 1.35 | 4.3 | 80 | 2 |
| 74 | 1.39 | 4.5 | 60 | 2 |
| 75 | 1.36 | 4.2 | 80 | 2 |
| 76 | 1.38 | 4.6 | 60 | 2 |
| 77 | 1.30 | 4.2 | 40 | 2 |

TABLE 17-continued

| Properties of Compositions of the Invention Containing a Range of Different Emulsion Components | | | | |
|---|---|---|---|---|
| Example | Property | | | |
| No | ρ | VOD | ADC | SEN |
| 78 | 1.32 | 3.1 | 20 | 6 |
| 79 | 1.31 | 2.9 | 20 | 6 |
| 80 | 1.36 | 3.0 | 20 | 3 |
| 81 | 1.35 | 3.1 | 20 | 3 |
| 82 | 1.37 | 2.8 | 40 | 6 |
| 83 | 1.37 | 3.0 | 20 | 6 |
| 84 | 1.33 | 4.4 | 60 | 2 |

For Code see TABLE 2

EXAMPLES 85–98

These Examples illustrate explosive compositions of the invention comprising melt-in-oil emulsion components.

Melt-in-oil emulsion compositions are prepared by forming a melt of the oxygen-relasing salt(s) and melt-soluble compound(s) and adding the melt with rapid stirring, to a liquid mixture of the organic fuel and the emulsifier. On completion of the mixing any discontinuous gaseous phase is blended in and the mixture is allowed to cool to give a stable melt-in-oil emulsion.

Explosive compositions of the present invention comprising melt-in-oil emulsion components may be prepared following essentially the same procedure as that described in Examples 1 to 22. Details of the ingredients of Example compositions 85 to 92 follow: ethylene glycol dinitrate (40 parts); nitroglycerine (60 parts); nitrocotton (3 parts); ammonium nitrate (crushed porous prill; 461 parts); starch (22 parts); polystyrene beads (10 parts); sorbitan mono-oleate (2 parts); sorbitan sesquioleate (2 parts); and emulsion component (400 parts). Details of the ingredients of Example compositions 93 to 98 follow: ethylene glycol dinitrte (118 parts); nitrocotton (2 parts); ammonium nitrate (470 parts); starch (16 parts); wood meal (10 parts); phenolic balloons (10 parts); sorbitan mono-oleate (4 parts); and emulsion component (37 parts). Details of the ingredients of the melt-in-oil emulsion component are set out in Table 18.

TABLE 18

| Melt-in-Oil Emulsion Component of Examples 85 to 98 | | | | | | | | | | | | |
|---|---|---|---|---|---|---|---|---|---|---|---|---|
| Example | Melt-in-Oil Emulsion Ingredients (parts by weight) | | | | | | | | | | | |
| No | AN | SN | MAN | EAN | HMN | TEAN | UR | PO | MW | PW | S | SS |
| 85 | 726 | 86 | — | — | — | — | 153 | 14 | — | — | 11 | 10 |
| 86 | 739 | 89 | — | — | — | — | 158 | 7 | — | — | 4 | 3 |
| 87 | 730 | 87 | — | — | — | — | 155 | 7 | — | — | 11 | 10 |
| 88 | 726 | 86 | — | — | — | — | 153 | 5 | — | 9 | 11 | 10 |
| 89 | 475 | — | 161 | — | — | — | 314 | 32 | — | — | 9 | 9 |
| 90 | 525 | 76 | 170 | — | — | — | 180 | 32 | — | — | 9 | 9 |
| 91 | 451 | 71 | 286 | — | — | — | 142 | 32 | — | — | 9 | 9 |
| 92 | 600 | 50 | — | — | 300 | — | — | 12 | — | 20 | 9 | 9 |
| 93 | 190 | — | 143 | 332 | — | — | 285 | 6 | 11 | 11 | 10 | 12 |
| 94 | 95 | — | — | 618 | — | — | 237 | 6 | 11 | 11 | 10 | 12 |
| 95 | 95 | — | 95 | — | — | 665 | 95 | 6 | 11 | 11 | 10 | 12 |
| 96 | — | — | 475 | 190 | — | — | 285 | 6 | 11 | 11 | 10 | 12 |
| 97 | — | — | 190 | — | — | 380 | 380 | 6 | 11 | 11 | 10 | 12 |
| 98 | — | — | 190 | 523 | — | — | 237 | 6 | 11 | 11 | 10 | 12 |

For Code see TABLE 1

EXAMPLES 99 TO 104

These Examples illustrate explosive compositions of the invention comprising dynamite components containing a range of liquid explosive nitric esters.

A series of explosive compositions of the present invention were prepared following essentially the same procedure as that described for Examples 1 to 22. The ingredients and their proportions are as follows: liquid explosive nitric ester (170 parts); nitrocotton (6 parts); ammonium nitrate (465 parts); starch (45 parts); phenolic balloons (10 parts); and emulsion component (300 parts). The liquid explosive nitric ester used in each of the Example compositions is detailed in Table 19. The emulsion component used in each of the Example compositions was the same as that described for Examples 23 to 28.

TABLE 19

| Compositions of the Invention Containing a Range of Different Liquid Explosive Nitric Esters | |
|---|---|
| Example No | Liquid Explosive Nitric Ester |
| 99 | Nitroglycerine |
| 100 | Nitroglycerine (50%)/Ethylene glycol dinitrate (40%) |
| 101 | Ethylene glycol dinitrate (50%)/ Metriol trinitrate (50%) |
| 102 | Ethylene glycol dinitrate (10%)/ Metriol trinitrate (90%) |
| 103 | Nitroglycerine (20%)/Metriol trinitrate (80%) |
| 104 | Metriol trinitrate |

EXAMPLES 105 TO 112

These Examples illustrate explosive compositions of the present invention comprising dynamite components containing combinations of liquid explosive nitric esters and nitroaromatic compounds.

A series of explosive compositions of the present invention were prepared following essentially the same procedure as that described for Examples 1 to 22. The emulsion composition used was the same as that described for Eamples 23 to 28. The ingredients and their proportions are set out in Table 20.

TABLE 20

Compositions of the Invention containing Combinations of Liquid Explosives Nitric Ester and Nitroaromatic Compounds

| Ex- ample | Ingredients (parts by weight) | | | | | | | | | |
|---|---|---|---|---|---|---|---|---|---|---|
| No | NG | DNT | TNT | NC | AN | ST | SS | PB | PS | EC |
| 105 | 180 | 20 | 40 | 2 | 520 | 20 | 3 | 10 | 5 | 200 |
| 106 | 180 | 40 | — | 3 | 540 | 20 | 3 | 10 | 4 | 200 |
| 107 | 180 | 60 | — | 3 | 510 | 30 | 3 | 10 | 4 | 200 |
| 108 | 180 | 75 | — | 3 | 514 | 10 | 3 | 10 | 5 | 200 |

TABLE 20-continued

Compositions of the Invention containing Combinations of Liquid Explosives Nitric Ester and Nitroaromatic Compounds

| Example No | Ingredients (parts by weight) | | | | | | | | | |
|---|---|---|---|---|---|---|---|---|---|---|
| | NG | DNT | TNT | NC | AN | ST | SS | PB | PS | EC |
| 109 | 160 | — | 40 | 2 | 450 | 30 | 3 | 10 | 5 | 300 |
| 110 | 160 | — | 60 | 2 | 430 | 30 | 3 | 10 | 5 | 300 |
| 111 | 160 | — | 80 | 2 | 415 | 25 | 3 | 10 | 5 | 300 |
| 112 | 160 | 20 | 60 | 2 | 415 | 25 | 3 | 10 | 5 | 300 |

For Code see TABLE 1

COMPARATIVE EXAMPLE

This Example illustrates the improved properties of the compositions of the present invention in comparison to standard prior art dynamite compositions.

A direct comparison was made of a number of properties of an explosive composition of the present invention (Example 19) and a prior-art standard dynamite composition (Comparative Example B). The results are detailed in Table 21. All results were obtained using 25×200 mm cartridges.

TABLE 21

| Property | Example 19 | Comparative Example B |
|---|---|---|
| Density (g/cm$^3$) | 1.30–1.33 | 1.38–1.42 |
| VOD (km/sec) | 3.6–4.4 | 2.9–3.9 |
| Energy (MJ/kg) | | |
| shock | 0.25 | 0.20 |
| bubble | 2.30 | 1.80 |
| Impact Sensitivity (cm) (10 kg weight) | >160 | 29–46 |
| EGDN Vapor Level (mg/m$^3$) (Laboratory, 20° C.) | | |
| 1 hour | 10 | 22 |
| 2 hour | 16 | 33 |
| 3 hour | 20 | 43 |
| Post Detonation Fumes | | |
| $NO_x$ (g/kg explosive) | 45 | 63 |
| CO (g/kg explosive) | 30 | 46 |

We claim:

1. In a dynamite-type explosive composition wherein the essential explosive material comprises at least one liquid explosive nitric ester, the improvement whereby the amount of liquid explosive nitric ester in the composition is reduced without effecting the performance and physical properties of the composition, said improvement comprising including in said composition an emulsion component which comprises an oxygen-releasing salt phase, an organic fuel phase and an emulsifier.

2. A dynamite-type explosive composition according to claim 1 wherein the liquid explosive nitric ester of said dynamite component is selected from the group consisting of nitroglycerine, ethylene glycol mononitrate, ethylene glycol dinitrate, diethylene glycol dinitrate, triethylene glycol dinitrate, trimethylene glycol dinitrate, methyl glycol dinitrate, 1,3-butylene glycol dinitrate, butane-1,2,4-triol trinitrate, 1,1,1-trimethylolethane trinitrate, dimethylolnitroethane dinitrate, liquid explosive nitric esters of sugars and sugar derivatives and mixtures thereof.

3. A dynamite-type explosive composition according to claim 1 or claim 2 wherein the liquid explosive nitric ester of said dynamite component is selected from the group consisting of nitroglycerine, ethylene glycol dinitrate, 1,1,1-trimethylolethane trinitrate and mixtures thereof.

4. A dynamite-type explosive composition according to claim 1 wherein said dynamite component comprises a liquid explosive nitric ester and one or more solid additives.

5. A dynamite-type explosive composition according to claim 4 wherein said solid additives are selected from the group consisting of inorganic oxygen-releasing salts, solid carbonaceous materials, solid fillers and mixtures thereof.

6. A dynamite-type explosive composition according to claim 4 or claim 5 wherein said solid additives include at least one oxygen-releasing salt.

7. A dynamite-type explosive compsition according to claim 6 wherein said oxygen-releasing salt is selected from the group consisting of the alkali metal and alkaline earth metal nitrates and ammonium nitrate.

8. A dynamite-type explosive composition according to claim 5 wherein said solid additives include at least one solid carbonaceous material or fuel.

9. A dynamite-type explosive composition according to claim 8 wherein said solid carbonaceous material or fuel is selected from the group consisting of asphalt, naphthalene, sugar, urea, hexamethylenetetramine, sawdust, wood pulp, wood meal, wheat flour, starch and mixtures thereof.

10. A dynamite-type explosive composition according to claim 5 wherein said solid additives include at least one solid filler.

11. A dynamite-type explosive composition according to claim 10 wherein said solid filler is selected from the group consisting of calcium carbonate, china clay, barium sulfate, sodium chloride, ammonium phosphates and mixtures thereof.

12. A dynamite-type explosive composition according to claim 1 wherein said dynamite component further comprises a surface active agent.

13. A dynamite-type explosive composition according to claim 1 which further comprises a discontinuous gaseous phase.

14. A dynamite-type explosive composition according to claim 1 wherein said liquid explosive nitric ester is gelatinized.

15. A dynamite-type explosive composition according to claim 1 wherein the inorganic oxygen-releasing salt of said emulsion component is selected from the group consisting of the alkali and alkaline earth metal nitrates, chlorates and perchlorates, ammonium nitrate, ammonium chlorate, ammonium perchlorate, and mixtures thereof.

16. A dynamite-type explosive composition according to claim 15 wherein said inorganic oxygen-releasing salt is selected from the group consisting of ammonium nitrate, sodium nitrate, calcium nitrate and mixtures thereof.

17. A dynamite-type explosive composition according to claim 1 wherein the continuous organic phase of said emulsion component is selected from the group consisting of mineral oils, fuel oils, lubricating oils, diesel oils, distillate, kerosene, naphtha, slack wax, microcrystalline waxes, paraffin waxes, paraffin oils, benzene, toluene, xylenes, dinitrotoluenes, asphaltic materials, polymeric oils, animal oils, vegetable oils, fish oils and mixtures thereof.

18. A dynamite-type explosive composition according to claim 17 wherein the continuous organic phase is selected from the group consisting of gasoline, kerosene, fuel oils, lubricating oils, paraffin oils, paraffin waxes, slack wax, microcrystalline waxes and mixtures thereof.

19. A dynamite-type explosive composition according to claim 1 wherein the emulsifier of said emulsion component is selected from the group consisting of sorbitan fatty acid esters, poly(oxyethylene) sorbitan esters, alkyl- and alkenyloxazolines, salts of fatty acids, mono- and diglycerides of fatty acids, poly(oxyalkylene) fatty acid esters, alkyl- and alkenyl-imidazolines, alcohol alkoxylates, phenol alkoxylates, alkylphenol alkoxylates, ethylene oxide/propylene oxide block copolymers, alkylsulfonates, alkylarylsulfonates, alkylphosphates, alkenylphosphates, alkylamines and the salts thereof, soyabean lecithin, lanolin derivatives, and mixtures thereof.

20. A dynamite-type explosive composition according to claim 1 wherein the emulsifier of said emulsion component is selected from the group consisting of sorbitan mono-oleate, sorbitan sesquioleate, sorbitan monostearate, sorbitan tristearate, sorbitan monolaurate, sorbitan monopalmitate, poly(oxyethylene) sorbitan mono-oleate, poly(oxyethylene) stearyl ether, 2-(8-heptadecenyl)-4,4-bis(hydroxymethyl)-2-oxazoline, soyabean lecithin, and mixtures thereof.

21. A dynamite-type explosive composition according to claim 1 wherein said emulsion component further comprises a discontinuous gaseous phase.

22. A dynamite-type explosive composition according to claim 21 wherein said discontinuous gaseous phase comprises gas bubbles, microballoons, porous particles or mixtures thereof.

23. A dynamite-type explosive composition according to claim 1 wherein said emulsion component further comprises a secondary fuel material selected from the group consisting of carbonaceous materials and finely divided elements.

24. A dynamite-type explosive composition according to claim 23 wherein said secondary fuel is aluminium powder.

25. A dynamite-type explosive composition according to claim 1 wherein said emulsion component is a water-in-oil emulsion comprising a discontinuous aqueous phase comprising discrete droplets of an aqueous solution of at least one inorganic oxygen-releasing salt, a continuous waterimmiscible organic phase throughout which the droplets are dispersed, and an emulsifier which forms an emulsion of the droplets of the aqueous oxygen-releasing salt phase throughout the continuous organic phase.

26. A dynamite-type explosive composition according to claim 1 wherein said emulsion composition is a melt-in-oil emulsion comprising a discontinuous phase comprising discrete droplets of a melt comprising at least one inorganic oxygen-releasing salt, a continuous organic phase throughout which the droplets are dispersed, and an emulsifier which forms an emulsion of the droplets of the inorganic oxygen-releasing salt melt throughout the continuous organic phase.

27. A dynamite-type explosive composition according to claim 26 wherein said melt comprises an inorganic oxygen-releasing salt and at least one melt-soluble compound.

28. A dynamite-type explosive composition according to claim 27 wherein said melt-soluble compound is selected from the group consisting of the alkali and alkaline earth metal nitrates, lead nitrate, silver nitrate, alcohols, glycols, polyols, carbohydrates, carboxylic acids and the salts thereof, amines and the salts thereof, thiocyanates, amides, and mixtures thereof.

29. A dynamite-type explosive composition according to claim 27 or 28 wherein said melt-soluble compound is selected from the group consisting of sodium nitrate, urea, methylamine nitrate, hydrazine mononitrate, ethanolamine nitrate, triethylamine nitrate and mixtures thereof.

30. A dynamite-type explosive composition according to claim 1 wherein said dynamite component comprises from 25 to 99 percent by weight of said composition and said emulsion component comprises from 1 to 75 percent by weight of said composition.

31. A dynamite-type explosive composition according to claim 1 wherein said dynamite component comprises from 5 to 100 percent by weight of liquid explosive nitric ester, from 0 to 95 percent by weight of solid additives, from 0 to 10 percent by weight of a gelatinizing agent, from 0 to 10 percent by weight of surface active agent and from 0 to 5 percent by weight of a discontinuous gaseous phase.

32. A dynamite-type explosive composition according to claim 25 wherein said water-in-oil emulsion component comprises from 50 to 95 percent by weight of inorganic oxygen-releasing salt, from 2 to 30 percent by weight of water from 2 to 15 percent by weight of oil, from 0.1 to 5 percent by weight of emulsifier, from 0 to 30 percent by weight of secondary fuel material and from 0 to 6 percent of weight of a discontinuous gaseous phase.

33. A dynamite-type explosive composition according to claim 26 wherein said melt-in-oil emulsion component comprises from 75 to 95 percent by weight of said melt, from 2.5 to 25 percent by weight of oil, from 0.5 to 10 percent by weight of emulsifier, from 0 to 30 percent by weight of secondary fuel material and from 0 to 6 percent by weight of a discontinuous gaseous phase.

34. A process for the preparation of a dynamite-type explosive composition according to claim 1, which process comprises blending said dynamite component and said emulsion component together to form a uniform composition.

* * * * *